United States Patent [19]

Miyaki

[11] Patent Number: 4,562,810

[45] Date of Patent: Jan. 7, 1986

[54] FUEL INJECTION PUMP

[75] Inventor: Masahiko Miyaki, Oobu, Japan

[73] Assignee: Nippondenso Co., Ltd., Kariya, Japan

[21] Appl. No.: 622,236

[22] Filed: Jun. 19, 1984

[30] Foreign Application Priority Data

Jun. 23, 1983 [JP] Japan ..... 58-113126
Nov. 4, 1983 [JP] Japan ..... 58-208018

[51] Int. Cl.[4] ..... F02D 7/00

[52] U.S. Cl. ..... 123/380; 123/382; 123/383; 123/506

[58] Field of Search ..... 123/506, 503, 449, 458, 123/459, 357, 380, 383, 382

[56] References Cited

U.S. PATENT DOCUMENTS

| | | | |
|---|---|---|---|
| 4,348,998 | 9/1982 | Stumpp | 123/506 |
| 4,385,614 | 5/1983 | Eheim et al. | 123/506 |
| 4,395,987 | 8/1983 | Kobayashi et al. | 123/506 |
| 4,403,582 | 9/1983 | Yasuhara | 123/503 |
| 4,407,249 | 10/1983 | Eheim | 123/449 |
| 4,449,500 | 5/1984 | Kawatei et al. | 123/503 |

FOREIGN PATENT DOCUMENTS

| | | | |
|---|---|---|---|
| 51-34936 | 9/1976 | Japan . | |
| 5423 | 1/1980 | Japan | 123/503 |
| 41462 | 3/1982 | Japan | 123/506 |
| 193727 | 11/1982 | Japan | 123/383 |
| 2079364 | 1/1981 | United Kingdom | 123/383 |
| 2061403 | 5/1981 | United Kingdom | 123/506 |

*Primary Examiner*—Magdalen Y. C. Moy
*Attorney, Agent, or Firm*—Cushman, Darby & Cushman

[57] ABSTRACT

A fuel injection pump according to the present invention is provided with a spill passage and an escape passage which are connected to a pump chamber. Disposed in the middle of the spill passage is a solenoid valve, which is adapted to open the spill passage to spill fuel in the pump chamber to the low-pressure side at predetermined times while the fuel in the pump chamber is pressurized by a pump plunger, thereby adjusting the delivery of compressed fuel from the fuel injection pump. The escape passage is formed in the pump plunger so as to be coaxial therewith. One end of the escape passage communicates with the pump chamber, while the other end opens to the outer peripheral surface of the pump plunger. An escape ring is fitted on the outer peripheral surface of the pump plunger, whereby the opening of the escape passage is opened when the pump plunger reaches a predetermined compression stroke.

14 Claims, 10 Drawing Figures

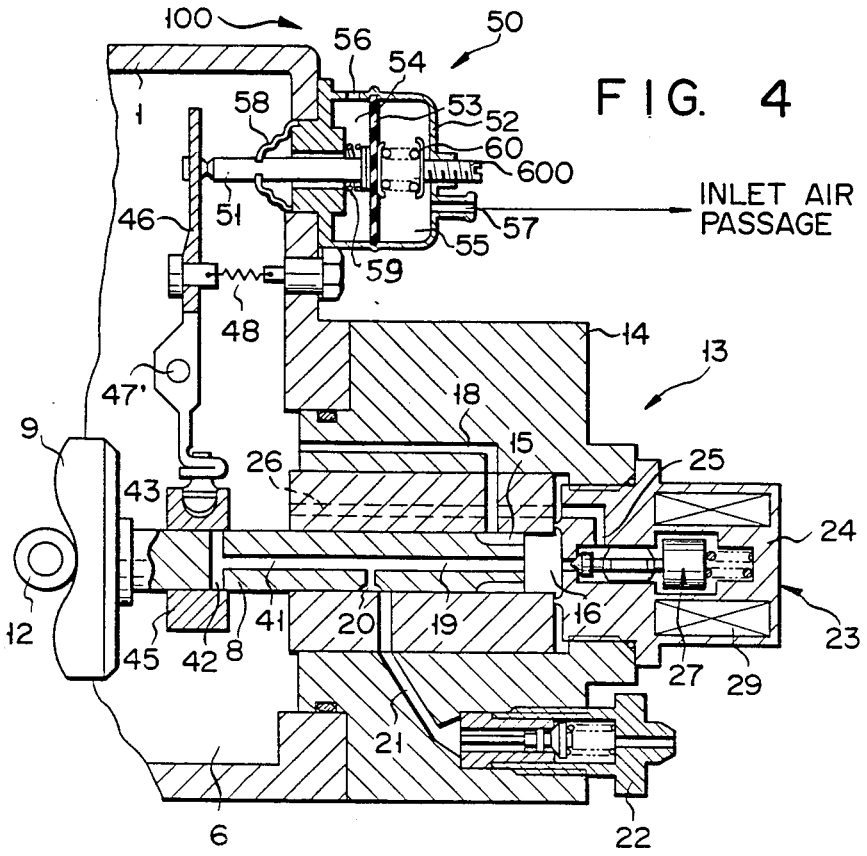
FIG. 4
FIG. 5
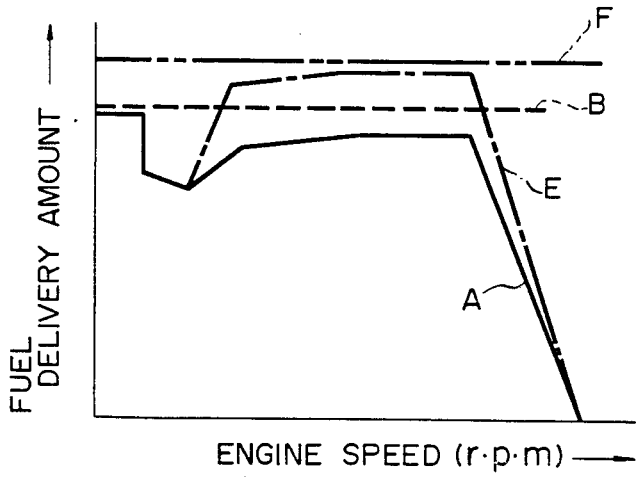

FUEL INJECTION PUMP

BACKGROUND OF THE INVENTION

The present invention relates to a fuel injection pump for delivering fuel under high pressure to a plurality of cylinders of an internal combustion engine, and more specifically to a fuel injection pump designed so that when highly pressurized or compressed fuel is delivered from a pump chamber of the fuel injection pump toward one of the engine cylinders, the fuel delivery can be adjusted by spilling the compressed fuel to a low-pressure region on the side of a fuel tank by means of a solenoid valve, thereby bringing the delivery of the compressed fuel to an end.

A conventional fuel injection pump of this type, for example, a fuel supply system for an internal combustion engine is described in Japanese Patent Publication No. 34936/76.

A solenoid valve to be used in the fuel injection pump of this type can be controlled for its valve-opening time in accordance with the operating conditions of the engine, such as engine load, speed, etc. In the fuel injection pump with the solenoid valve for controlling the delivery of compressed fuel, therefore, the fuel delivery can be adjusted to an optimum level for operating the engine.

Despite these advantages, the fuel injection pump of this type has some drawbacks. For example, if the solenoid of the solenoid valve suffers disconnection, or if a drive circuit for the solenoid valve gets out of order, the solenoid will not be able to be controlled normally, that is, the solenoid valve will fail to open correctly at predetermined times. In such a case, all the compressed fuel pressurized by a pump plunger in a pump chamber of the fuel injection pump will be delivered toward one of the engine cylinders. In other words, the compressed fuel will be delivered from the pump chamber for the whole compression stroke of the pump plunger used in the compression of the fuel in the pump chamber. Specifically, in case of such a problem, the fuel delivery to the engine cylinders will be 1.5 to 2 times as great as the maximum fuel delivery obtained with the normal control of the solenoid valve. Accordingly, the engine will suffer an undue increase of the rotational frequency, as well as producing an extraordinary amount of black smoke in its exhaust gas.

SUMMARY OF THE INVENTION

A first object of the present invention is to provide a fuel injection pump capable of restricting the amount of compressed fuel delivered therefrom to an allowable maximum delivery even if a solenoid valve used therein cannot be controlled normally.

A second object of the invention is to provide a fuel injection pump capable of varying the allowable maximum fuel delivery according to the operating conditions of the engine when the solenoid valve is controlled normally.

A third object of the invention is to provide a fuel injection pump in which the allowable maximum fuel delivery is adjusted to a low level high enough to permit the low-speed rotation of engine.

The above object of the present invention is attained by a fuel injection pump which comprises a pump housing with a pump chamber defined therein to which the fuel is supplied from a fuel tank. It also has fuel compression and delivery means for compressing the fuel in the pump chamber of the pump housing and delivering the compressed fuel to the engine cylinders, the fuel compression and delivery means including a pump plunger adapted to be reciprocated to introduce the fuel into the pump chamber and to pressurize the introduced fuel. Spill means are provided for spilling to the low-pressure side on the fuel tank side the compressed fuel pressurized in the pump chamber of the pump housing and bound to be delivered from the pump chamber toward the engine cylinders. The spill means include a spill passage communicating with the pump chamber of the pump housing. Also included is a solenoid valve in the spill passage for opening and closing the spill passage with a predetermined timing, and escape means for allowing the compressed fuel pressurized in the pump chamber of the pump housing and bound to be delivered from the pump chamber toward the engine cylinders to escape to the low-pressure side on the fuel tank side, the escape means including an escape passage communicating with the pump chamber of the pump housing. Further included is a gate unit for opening and closing the escape passage, the gate unit being adapted to open the escape passage when the pump plunger is moved for a predetermined compression stroke to pressurize the fuel in the pump chamber.

According to the present invention, even if the solenoid valve for controlling the spill passage malfunctions so that the compressed fuel pressurized in the pump chamber cannot be spilled therefrom through the spill passage, delivery of the compressed fuel from the pump chamber to the engine cylinders can be stopped by opening an escape passage separate from the spill passage with a predetermined timing by means of the gate unit. In this case, if the amount of compressed fuel delivered from the pump chamber toward the engine cylinders is restricted to an allowable maximum amount by opening the escape passage with the predetermined timing, there is no possibility of excessive compressed fuel being delivered toward the engine cylinders. Thus, the engine will suffer neither an undue increase of its rotational frequency nor will produce an extraordinary amount of black smoke in its exhaust gas.

In a preferred embodiment of the invention, the escape passage is formed in the pump plunger so as to be coaxial therewith, and has two ends communicating with the pump chamber and opening to the outer peripheral surface of the pump plunger. The opening timing for the escape passage can be mechanically controlled by opening or closing the other end opening of the escape passage by means of the escape ring which is slidably fitted in a liquid-tight manner on the outer peripheral surface of the pump plunger. In this case, therefore, an electrical malfunction, such as a problem in the solenoid valve, will never be caused.

In an alternative embodiment of the invention as an improvement of the aforementioned embodiment, the escape means is further provided with an actuator mechanism for axially moving the escape ring on the pump plunger in accordance with the operating state of the engine. The allowable maximum delivery of the compressed fuel can be varied in accordance with the operating state of the engine by operating the actuator mechanism.

If the solenoid valve gets out of order, the actuator mechanism can adjust the position of the escape ring on the pump plunger to a position to allow the delivery of a small amount of compressed fuel to permit the low-speed rotation of the engine, or to reduce the compressed fuel delivery to zero.

BRIEF DESCRIPTION OF THE DRAWINGS

FIG. 4 is a partial sectional view of a distributor-type fuel injection pump according to a second embodiment of the invention;

FIG. 5 shows characteristic curves representing the fuel delivery characteristic of the fuel injection pump of FIG. 4;

DETAILED DESCRIPTION OF THE PREFERRED EMBODIMENTS

Figure 1:
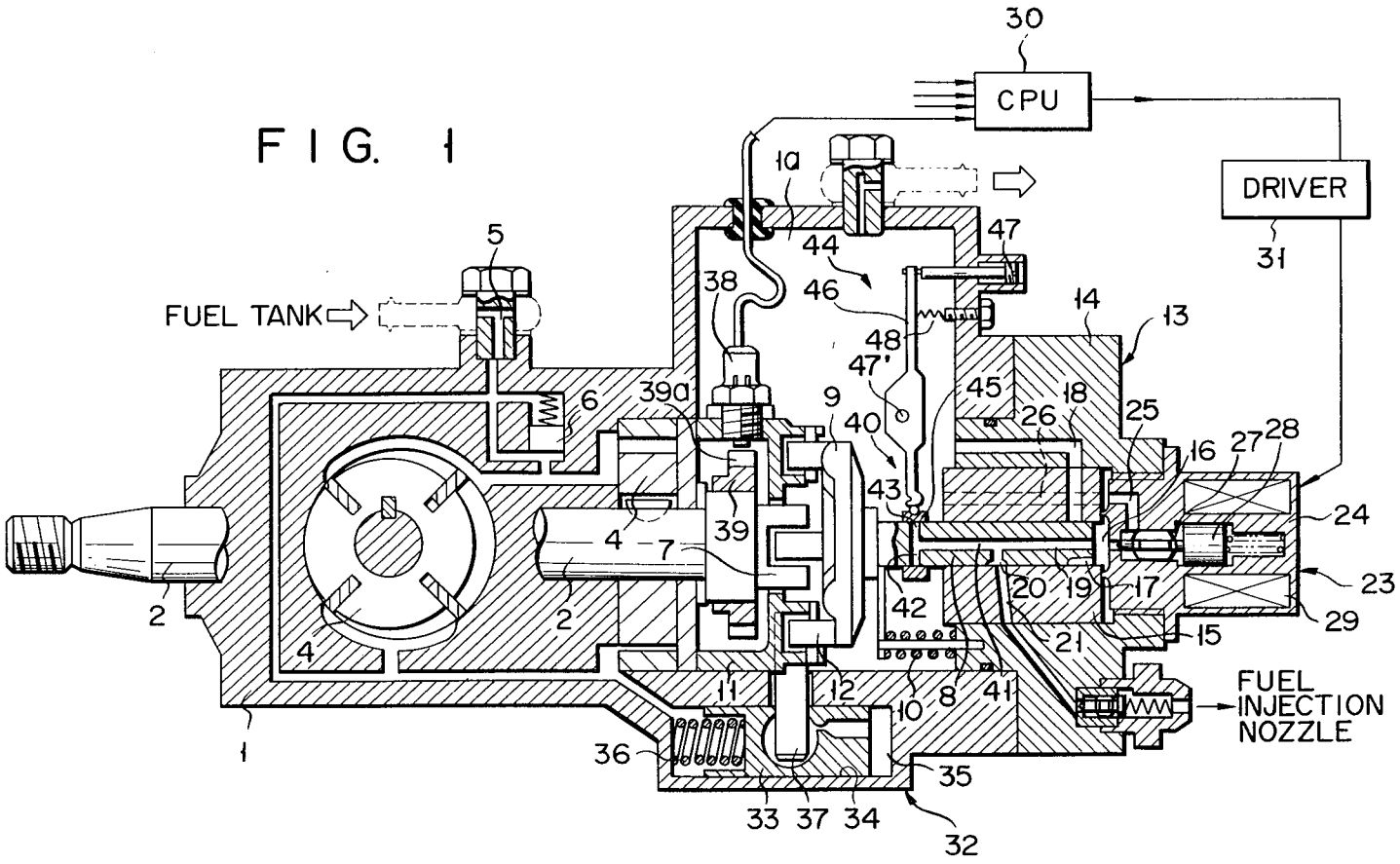
FIG. 1 is a sectional view of a distributor-type fuel injection pump according to a first embodiment of the present invention.
Figure 2:
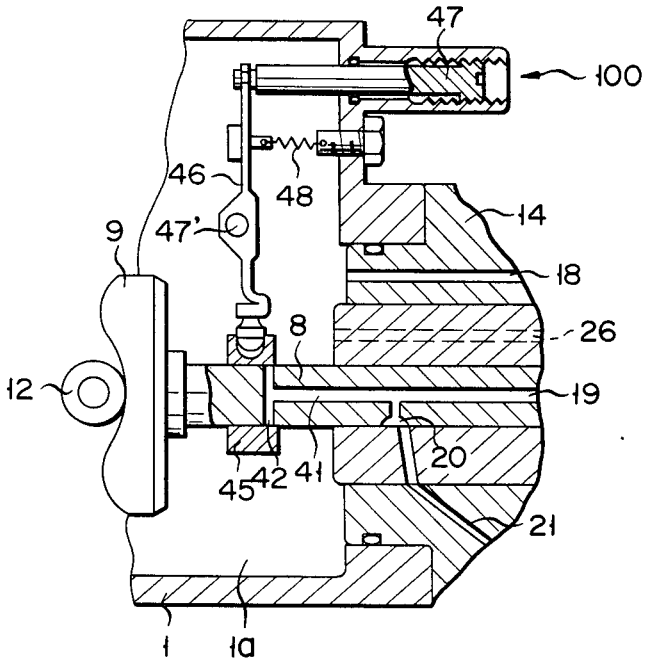
FIG. 2 is an enlarged view of an actuator mechanism of the fuel injection pump shown in FIG. 1.
Figure 3:
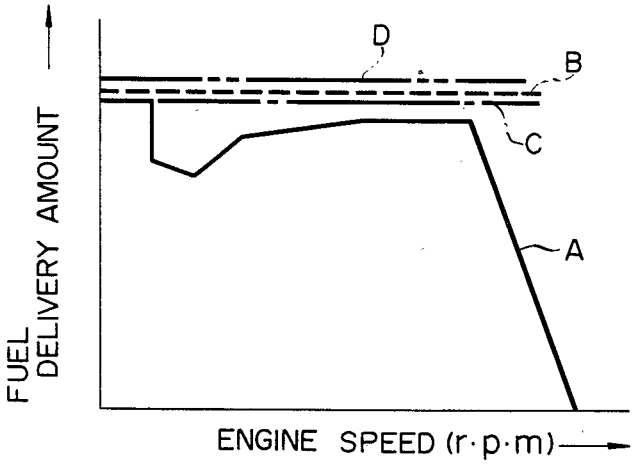
FIG. 3 shows characteristic curves representing the fuel delivery characteristic of the fuel injection pump of FIG. 1.

Referring now to FIGS. 1 to 3, there is shown one embodiment of the present invention. FIG. 1 shows an outline of a distributor-type fuel injection pump. Since the fuel injection pump of this type is generally known, the construction and function of the conventional portions of the fuel injection pump will first be described in brief. The distributor-type fuel injection pump is provided with a pump housing 1, in which a fuel supply chamber 1*a* is defined. A drive shaft 2 is rotatably supported by the pump housing 1. The drive shaft 2 drives a conventional vane-type feed pump 4. The feed pump 4 sucks in fuel from a fuel tank (not shown) through an inlet port 5 of the pump housing 1 and a filter (not shown), and then pressurizes and feeds the fuel into the fuel supply chamber 1*a* in the pump housing 1. The pressure of the fuel fed into the fuel supply chamber 1*a* by the feed pump 4 is adjusted to a pressure level set by a regulating valve 6. In FIG. 1, the feed pump 4 is shown in two difference-phase sections at the same time (i.e. the "insert" portion illustrates the feed pump 4 rotated 90° to show details thereof).

One end of the drive shaft 2 extending into the pump housing 1 is connected to a plunger 8 by means of a coupling 7. The coupling 7 causes the plunger 8 to rotate together with the drive shaft 2, while it allows the plunger 8 to reciprocate axially as against the drive shaft 2.

A face cam 9 is formed integrally on one end portion of the plunger 8 which adjoins the drive shaft 2. The face cam 9 is pressed against cam rollers 12 of a roller ring 11 by a spring 10 which is disposed between the face cam 9 and the inner wall of the pump housing 1. The roller ring 11 is supported on the inner wall of the pump housing 1 so as to be rockable around the axis of the drive shaft 2. Thus, when the face cam 9 is rotated in a manner such that its cam surface is in sliding contact with the cam roller 12, projected portions of the cam surface of the face cam 9 run onto the cam rollers 12, thereby reciprocating the plunger 8 in its axial direction. While the plunger 8 makes one revolution, it is reciprocated for the same number of cycles as there are engine cylinders (not shown).

The other end side of the plunger 8 is slidably accurately fitted in a distributing head 13 which constitutes part of the housing 1. More specifically, the distributing head 13 is composed of a head body 14 and a head cylinder 15 fitted therein, and the plunger 8 is slidably fitted in the head cylinder 15. Inside the head 13, a pump chamber 16 is defined by the other end face of the plunger 8.

Suction grooves 17 which number the same as the engine cylinders are formed on the peripheral surface of the other end portion of the plunger 8. When the plunger 8 is in its fuel suction stroke, that is, while it is being moved to the left of FIG. 1, one of the suction grooves 17 communicates with a suction passage 18 inside the head 13. As a result, the fuel from the fuel supply chamber 1*a* is fed into the pump chamber 16. When the plunger 8 is in its compression stroke, that is, while it is being moved to the right of FIG. 1, the fuel in the pump chamber 16 is compressed by the plunger 8, and delivered to delivery passages 21 through a communication passage 19 and a distributing hole 20 formed in the plunger 8. Then, fuel is injected into a combustion chamber of the engine via discharge valves 22 by an injection valve (not shown). The number of delivery passages 21 and the discharge valves 22 is equal to the number of engine cylinders.

Such a fuel delivery stroke is repeated for the same number of cycles as there are engine cylinders while the pump plunger 8 makes one revolution. Thus, the compressed fuel is delivered from the fuel injection pump to the individual engine cylinders.

There will now be described a spill mechanism 23 for adjusting the amount of compressed fuel delivered from the fuel injection pump. The spill mechanism 23 has a spill body 24 which is screwed into the outer end face of the distributing head 13. To be exact, the pump chamber 16 in the head cylinder 15 is defined between the other end face of the pump plunger 8 and the inner end face of the spill body 24. Formed in the spill body 24 is a first spill passage 25, one end of which opens into the pump chamber 16. The other end of the first spill passage 25 communicates with the fuel supply chamber 1*a* by means of a second spill passage 26 formed in the head cylinder 15.

The first spill passage 25 is controlled by a solenoid valve 27 contained in the spill body 24. In the solenoid valve 27, as seen from FIG. 1, a valve needle 28 is operated by a solenoid 29. When the solenoid 29 is energized, the needle 28 is lifted or moved to the right of FIG. 1, so that the pump chamber 16 is allowed to communicate with the first spill passage 25. Therefore, if the solenoid valve 27 is actuated when the pump plunger 8 is in the fuel compression/delivery stroke, the compressed fuel in the pump chamber 16 is allowed to spill through the first and second spill passages 25 and 26 into the fuel supply chamber 1*a* on the low-fuel-pressure side. As a result, the compressed fuel ceases to be delivered from the pump chamber 16 to the side of the delivery passages 21, that is, the delivery of the compressed fuel is stopped. Thus, the delivery of the compressed fuel to be supplied to the engine side can be regulated with use of the valve-opening timing of the solenoid valve 27, i.e., the timing for the actuation of the valve 27.

The valve-opening timing of the solenoid vlave 27 is controlled by an electronic circuit 30, e.g., a central processing unit (CPU). More specifically, the electronic circuit 30 is supplied with sensor signals from various sensors for detecting the operating conditions of the engine, such as the engine speed, accelerator pedal position, cooling water temperature, etc., and a timing signal from a timing detector 38 mentioned later. Based on these sensor and timing signals, the electronic circuit 30 logically calculates a valve-opening signal for opening the solenoid valve 27, and delivers it to a drive circuit 31 for the solenoid valve 27 at a predetermined time. Thus, the moment the valve-opening signal is delivered from the electronic circuit 30, the solenoid valve 27 is opened.

In FIG. 3, full-line curve A represents the fuel delivery characteristic of the fuel injection pump controlled by the solenoid valve 27 which is operated by the electronic circuit 30, as compared with the engine speed. In the normal operating state of the engine, when the solenoid valve 27 is opened normally, the delivery of the compressed fuel from the fuel injection pump is controlled in accordance with the characteristic indicated by full-line curve A of FIG. 3.

The fuel injection pump is further provided with a timer 32 for adjusting the delivery timing for the compressed fuel in accordance with the operating state of the engine. The timer 32 has a timer piston 33, which is slidably fitted in a timer cylinder hole 34 formed in the pump housing 1. The fuel in the fuel supply chamber 1*a* is fed into an oiltight chamber 35 of the timer cylinder hole 34 which is defined by one end face of the timer piston 33. Accordingly, the fuel pressure inside the fuel supply chamber 1*a* acts on one end of the timer piston 33. The fuel pressure inside the fuel supply chamber 1*a*, that is, the internal fuel pressure of the oiltight chamber 35, varies with the engine speed or the rotational frequency of the feed pump 4. Therefore, the timer piston 33 is axially reciprocated so that the force acting on the one end of the timer piston 33 in accordance with, e.g., the internal fuel pressure of the fuel supply chamber 1*a* is balanced with, the urging force of a spring 36 which acts on the other end of the timer piston 33. Such reciprocation of the timer piston 33 is transmitted to the roller ring 11 by a pin 37. In FIG. 1, the timer piston 33 is shown as extending along the axis of the drive shaft 2. Actually, however, the axis of the timer piston 33 extends at right angles to the drawing plane of FIG. 1. When the timer piston 33 is reciprocated, therefore, the roller ring 11 is rocked around the axis of the drive shaft 2 through the medium of the pin 37. This is done because the roller ring 11 is supported on the pump housing 1 so as to be rotatable around the axis of the drive shaft 2, as mentioned before. Consequently, the relation between the rotational phase angles of the cam rollers 12 of the roller ring 11 and the face cam 9 is changed, so that the projected portions of the cam surface of the face cam 9 run onto the cam rollers 12 with a time lag. Accordingly, the timing for the reciprocation of the pump plunger 8 changes relatively to the rotational phase of the drive shaft 2. Thus, as is normally the case with the distributor-type fuel injection pump, the timing for the communication between the distributing hole 20 and the delivery passages 21 changes, so that the fuel delivery timing is automatically regulated in accordance with the operating state of the engine.

The roller ring 11 is fitted with the aforementioned timing detector 38 of, e.g., an electromagnetic pickup type, Hall element type, or optical angle detection type. A pulser 39 is fixed to the drive shaft 2. When one of projections 39*a* (as many in number as the engine cylinders) radially protruding from the pulser 39 passes right under the timing detector 38 as the drive shaft 2 rotates, the timing detector 8 produces a timing signal. The timing signal represents the compression start timing for the fuel in the pump chamber 16. The timing signal is delivered to the electronic circuit 30. In a predetermined time after the reception of the timing signal, the electronic circuit 30 delivers an operation instruction signal to the drive circuit 31 for the solenoid valve 27, using the timing signal as a reference time signal.

When the roller ring 11 is rocked as the timer 32 is actuated, the timing detector 38 is also rocked through the same angle with the roller ring 11 around the axis of the drive shaft 2. Therefore, even if the fuel delivery timing is adjusted by the timer 32, the timing detector 38 and the roller ring 11 are held at the same phase angles to the drive shaft 2. As a result, even though the timer 32 is actuated, the output of the timing signal from the timing detector 38 is always coincident with the compression start timing for the fuel in the pump chamber 16.

Beside the spill mechanism 23, the fuel injection pump is provided with an escape means 40 for allowing the compressed fuel in the pump chamber 16 to escape to a low-pressure region on the fuel tank side. The escape means 40 will now be described in detail.

The escape means 40 is provided with an escape passage 41 which is formed inside the pump plunger 8 so as to be coaxial therewith. One end of the escape passage 41 opens into the pump chamber 16. In this first embodiment, as seen from FIG. 1, the escape passage 41 is combined in part with the communication passage 19. The other end of the escape passage 41 extends axially within the pump plunger 8 toward the face cam 9, and opens to the outer peripheral surface of the pump plunger 8 exposed to the fuel supply chamber 1*a* by means of at least one radial passage portion 42.

An escape port 43 of the escape passage 41 is opened and closed by a gate unit 44. The gate unit 44 includes an escape ring 45 which is accurately fitted on the outer peripheral surface of the pump plunger 8 and allows the pump plunger 8 to reciprocate freely. The escape ring 45 may be fixed to the pump housing 1 or the distributing head 12. In this first embodiment, however, it can be adjusted in its axial movement along the pump plunger 8 by an actuator mechanism 100. The actuator mechanism 100 includes a rocking lever 46, one end or the lower end of which engages the escape ring 45. The central portion of the rocking lever 46 is rockably supported on the pump housing 1 by a pin 47'. The other end or upper end of the rocking lever 46 engages a push rod 47 for adjustment. As shown in detail in FIG. 2, the push rod 47 is screwed in the outer wall of the pump housing 1. Accordingly the push rod 47 can be manually moved in its axial direction for adjustment from the outside of the pump housing 1. As shown in FIG. 2, the rocking lever 46 is connected to a screw, which is screwed in the outer wall of the pump housing, by means of a tension spring 48.

The position of the escape ring 45 on the pump plunger 8 is adjusted so that the escape port 43 of the escape passage 41 comes out from the escape ring 45 to be exposed to the fuel supply chamber 1*a* when the pump plunger 8 is moved beyond a necessary compression stroke for an allowable maximum fuel delivery. According to the delivery control characteristic of compressed fuel indicated by full-line curve A in FIG. 3, the maximum fuel delivery is obtained when the engine is started. Meanwhile, the escape ring 45 is located in a position such that the escape port 43 is opened when the pump plunger 8 is moved beyond the stroke for the fuel delivery on the level indicated by broken-line curve B which exceeds the maximum fuel delivery. Thus, in the fuel injection pump of this first embodiment, the fuel delivery indicated by curve B cannot be exceeded.

In the fuel injection pump according to the first embodiment described above, therefore, the fuel delivery is controlled in accordance with characteristic curve A of FIG. 3 where the solenoid valve 27 is operated normally. If the solenoid valve 27 suffers from a malfunction due to a disconnection in the solenoid 29, trouble in the drive circuit 31, or from an extraordinary battery voltage drop in the solenoid valve 27 because of very low temperatures or the like, then it is no longer possible to allow the compressed fuel to escape through the spill passages 25 and 26 into the fuel supply chamber 1*a*. In such an abnormal situation, however, when the pump plunger 8 covers the stroke for the allowable maximum fuel delivery, the escape port 43 goes beyond the escape ring 45 to be opened. Accordingly, the compressed fuel in the pump chamber 16 escapes into the fuel supply chamber 1*a* via the escape passage 41 (including the communication passage 19), the radial passage portion 42, and the escape port 43. Thus, the fuel delivery from the fuel injection pump will never exceed the delivery indicated by broken-line curve B of FIG. 3. As a consequence, the engine can be prevented from producing black smoke in its exhaust gas, as well as from rotating at an unduly high speed. At the time of starting, the engine can be prevented from extraordinarily increasing the speed of revolution.

If the position of the escape ring 45 is fixed, the allowable maximum fuel delivery obtained with the solenoid valve 27 in trouble is fixed at the level indicated by the broken-line curve B of FIG. 3. In the fuel injection pump of the first embodiment, however, the escape ring 45 is moved in the axial direction of the pump plunger 8 through the medium of the rocking lever 46 when the push rod 47 is adjusted. Accordingly, the timing with which the escape port 43 is opened by the escape ring 45 may vary, so that the allowable maximum delivery can be adjusted as indicated by broken-line curves C and D of FIG. 3, for example. Thus, the allowable maximum delivery can be changed according to the requirements of the engine.

The present invention is not limited to the first embodiment described above. Fuel injection pumps according to second through sixth embodiments of the invention will now be described. In the description to follow, like reference numerals are used to designate like members with the same functions used in the first embodiment.

Referring now to FIGS. 4 and 5, there is shown the fuel injection pump according to the second embodiment of the invention. The fuel injection pump of this second embodiment is suited for engines with superchargers and intercoolers. In some of the engines with intercoolers plus superchargers or with turbosuperchargers, the fuel injection quantity or fuel delivery from the fuel injection pump required for medium- or high-speed, high-load operation exceeds the rated starting fuel delivery, as indicated by characteristic curve E in FIG. 5. In the engines of this type, if the amount of compressed fuel delivered from the fuel injection pump is restricted to the allowable maximum delivery obtained when the solenoid valve 27 is in trouble, as indicated by the broken-line curve B of FIGS. 3 and 5 the fuel injection pump cannot provide the fuel delivery required by the engine for supercharging. To cope with this, the fuel injection pump according to this second embodiment has the construction as shown in the partial sectional view of FIG. 4.

In the actuator mechanism 100 of the fuel injection pump shown in FIG. 4, the rocking lever 46 is coupled to the distal end of a push rod 51 of a pneumatic actuator 50. The pneumatic actuator 50 has a casing 52 attached to the pump housing 1. The interior of the casing 52 is divided by a diaphragm 53 into an atmospheric pressure chamber 54 on the left-hand side of FIG. 4 and an intake pressure chamber 55 on the right-hand side. The atmospheric pressure chamber 54 communicates at all times with the outside air by means of an atmosphere port 56. The intake pressure chamber 55 communicates with the inlet air passage of the engine by means of a pipe 57 and a hose (not shown). As shown in FIG. 4, the proximal end of the push rod 51 is coupled to the diaphragm 53. The inner wall of the pump housing 1 and the push rod 51 are coupled in a liquid-tight manner by a bellows 58. The bellows 58 seals the fuel in the fuel supply chamber 1*a*, and allows the push rod 51 to move axially. The atmospheric pressure chamber 54 and the intake pressure chamber 55 of the casing 52 are provided with springs 59 and 60, respectively, for urging the diaphragm 53 in opposite directions along the axis of the push rod 51. By the use of the springs 59 and 60, the pressures on both the left and right sides of the diaphragm 53 balance each other. In this second embodiment, moreover, the urging forces of the springs 59 and 60 can be varied and adjusted by means of an adjust screw 600.

According to the fuel injection pump of the second embodiment, when the engine speed is raised up to the medium- or high-rotation range to increase the supercharging pressure, the pressure inside the intake pressure chamber 55 defined by the diaphragm 53 is also increased, and the diaphragm 53 is pushed to the left of FIG. 4. As a result, the push rod 51 is also pushed to the left, so that the rocking lever 46 is rocked counterclockwise. Accordingly, the escape ring 45 is moved to the right as against the pump plunger 8, so that the allowable maximum fuel delivery of the fuel injection pump can be increased, as indicated by characteristic curve F of FIG. 5, for example. In this case, therefore, the engine speed sensor detects that the engine is in the medium- or high-rotation range, and delays the output timing for the valve-opening signal for the solenoid valve 27 delivered from the electronic circuit 30 in accordance with a signal from the sensor. Thus, the delivery of fuel from the fuel injection pump can be controlled for the characteristic indicated by curve E in FIG. 5, without being restricted by the allowable maximum fuel delivery F.

Figure 6:
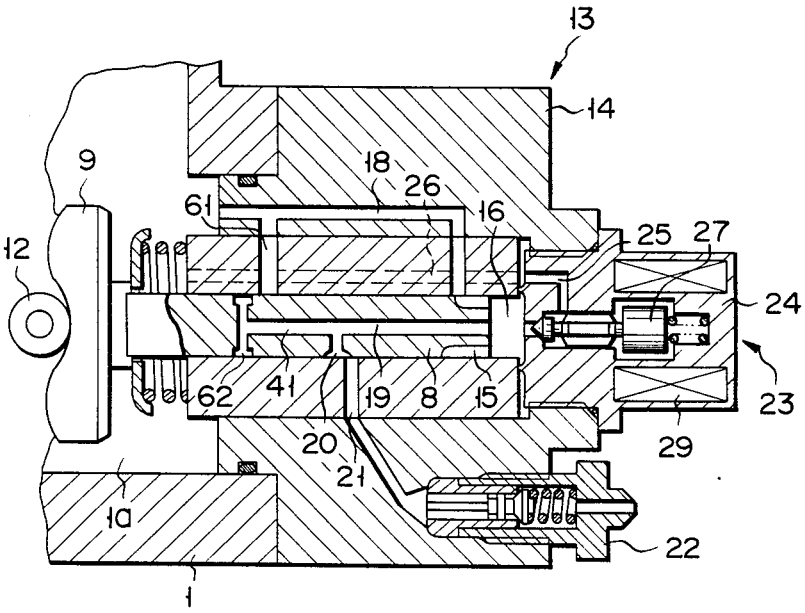
FIG. 6 is a partial sectional view of a distributor-type fuel injection pump according to a third embodiment of the invention.

Referring now to FIG. 6, there is shown the principal part of the fuel injection pump according to the third embodiment of the invention. Instead of using the escape ring 45, according to this third embodiment, an escape hole 61 is formed in the head cylinder 15 in which the pump plunger 8 is fitted. The escape hole 61 communicates with the fuel supply chamber 1*a*. A circumferential escape groove 62 is formed on the outer peripheral surface of the pump plunger 8 in place of the escape port 43.

Also in the fuel injection pump of the third embodiment, the escape groove 62 communicates with the escape hole 61 when the pump plunger 8 covers a predetermined compression stroke, so that the compressed fuel in the pump chamber 16 can be spilled into the fuel supply chamber 1*a*. The fuel injection pump of the third embodiment has the same function as in the case in which the escape ring 45 is fixed to the pump housing 1 or to another suitable member.

Figure 7:
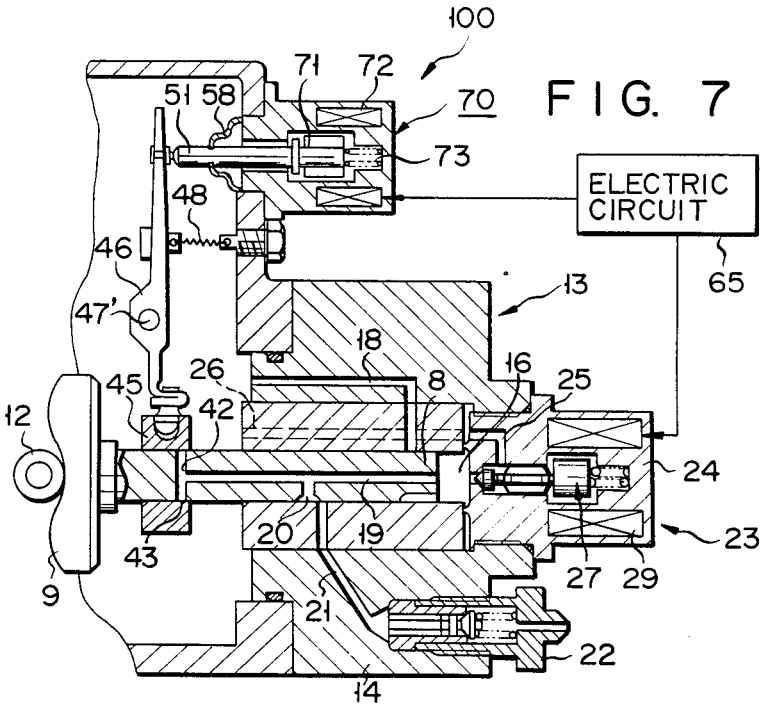
FIG. 7 is a partial sectional view of a distributor-type fuel injection pump according to a fourth embodiment of the invention.
Figure 8:
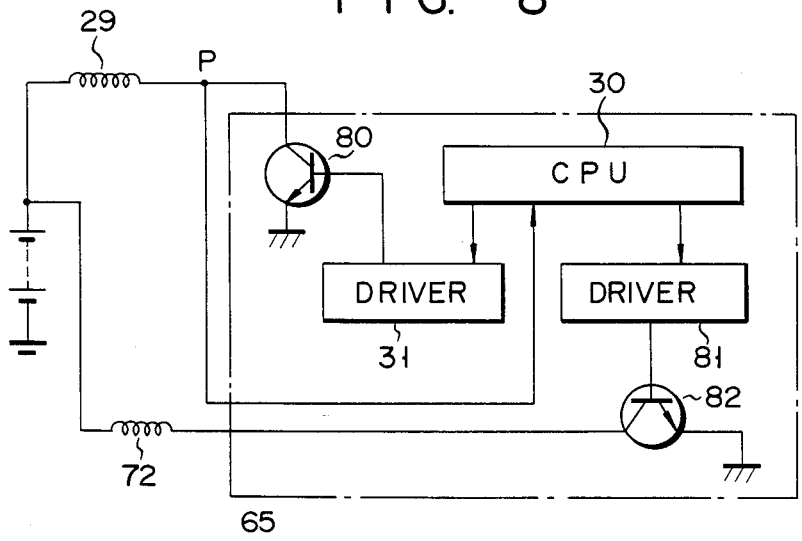
FIG. 8 is an electric circuit diagram applied to the fuel injection pump of FIG. 7.

Referring now to FIGS. 7 and 8, there is shown the principal part of the fuel injection pump according to the fourth embodiment of the invention.

In the fourth embodiment, construction of a solenoid actuator 70 will be described in brief. A core 71 formed of magnetic material is integrally attached to the push rod 51. When a solenoid 72 is energized, the push rod 51 and the core 71 integral therewith move to the right of FIG. 7, attracted by an electromagnetic force. When the solenoid 72 is de-energized, they are pushed to the left by a spring 73.

The solenoid 72 of the solenoid actuator 70 and the solenoid 29 of the solenoid vaive 27 are electrically connected to an electric circuit 65 mentioned later.

In the fuel injection pump of the fourth embodiment, if any trouble is detected in the solenoid valve 27 or in the drive circuit therefore, the solenoid 72 of the solenoid actuator 70 is energized by the electric circuit 65, and the push rod 51 and the core 71 are attracted to the right of FIG. 7. As a result, the escape ring 45 is moved to the left through the medium of the rocking lever 46 to reduce the fuel delivery.

In this case, the stroke of the push rod 51 may be set to an optimum length so that, in case of trouble, all the fuel in the pump chamber 16 is spilled into the fuel supply chamber 1*a* through the escape passage 41, thereby reducing the fuel delivery from the fuel injection pump to zero to stop the engine. Preferably, however, the stroke of the push rod 51 should be set in a manner such that the fuel injection pump can deliver a small amount of fuel to enable an automobile to run from the scene of the trouble to a nearby repair shop.

The construction of the electric circuit 65 used in the fourth embodiment will now be described.

In an example of a simple arrangement of the electric circuit 65, the engine speed is monitored at all times, and the solenoid 72 of the solenoid actuator 70 may be energized when the engine speed exceeds the rated maximum speed of the engine.

Preferably, the potential of part (e.g., section P of FIG. 8) of the wiring of the solenoid 29 of the solenoid valve 27 is first monitored. In the case of the circuit shown in FIG. 8, for example, the solenoid valve 27 is actuated by lowering the potential of the section P from the battery voltage to the ground level. Thus, the potential of the section P is sampled with every predetermined time interval (e.g., 5 milliseconds) by using the CPU 30 and the like. If the potential of the section P is maintained at a high level for a predetermined continuous time (e.g., 0.5 seconds), it is concluded that there is trouble therefor in the solenoid valve 27, the drive circuit 31 therefor or in a power transistor 80, and consequently, the solenoid 72 of the solenoid actuator 70 is energized. In FIG. 8, numeral 81 designates a drive circuit for the solenoid actuator 70, and 82 a power transistor.

In the fuel injection pump of this type to which the present invention is applied, an electronic control circuit including a microcomputer is usually used to control the solenoid valve 27. Therefore, the arrangement of FIG. 8 for the detection of trouble may be incorporated in part of the software and hardware of the electronic control circuit.

Figure 9:
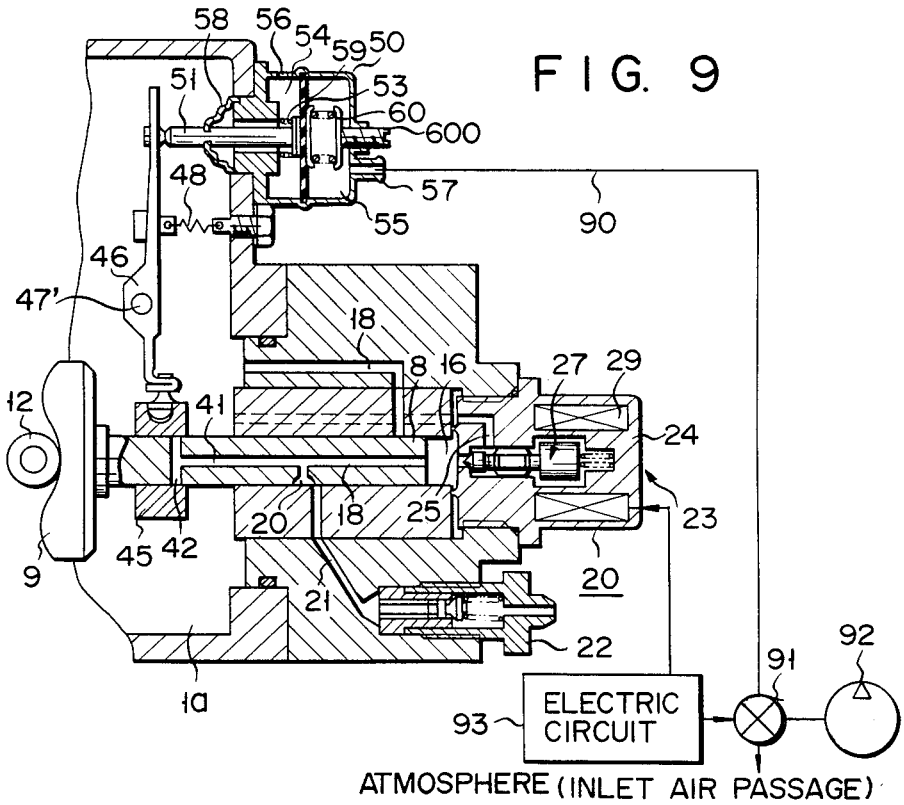
FIG. 9 is a partial sectional view of a distributor-type fuel injection pump according to a fifth embodiment of the invention.

Referring now to FIG. 9, there is shown part of the fuel injection pump according to the fifth embodiment of the invention.

In the fuel injection pump of this fifth embodiment, a pneumatic actuator 50 similar to the one used in the second embodiment is included in the actuator mechanism 100. The fifth embodiment differs from the second embodiment only in the following points. In the fifth embodiment, the intake pressure chamber 55 is opened to the atmosphere or connected to a vacuum pump 92 of brake booster, which is attached to, e.g., a generator, through the pipe 57, a piping system 90 and a three-way solenoid valve 91. Accordingly, the intake pressure chamber 55 is selectively supplied with a negative pressure. An electric circuit 93 including a drive circuit for the three-way solenoid valve 91 switches the three-way solenoid valve 91 so that the intake pressure chamber 55 is opened to the atmosphere when the solenoid valve 27 operates normally. At this time, the atmospheric pressure acts on both side faces of the diaphragm 53, so that the push rod 51 stops at the position where it is balanced by the springs 59 and 60 only. In this state, the escape ring 45 is positioned to set the allowable maximum fuel delivery, as described in connection with the second embodiment.

In this fifth embodiment, if the solenoid valve 27 suffers from trouble in the opening operation, the electric circuit 93 switches the three-way solenoid valve 91 to the negative-pressure side. As a result, the negative pressure is led into the intake pressure chamber 55 of the pneumatic actuator 50 to move the push rod 51 to the right of FIG. 9, so that the escape ring 45 moves to the left or in the direction to reduce the fuel delivery by the agency of the rocking lever 46. Thus, the fuel delivery from the fuel injection pump can be reduced to prevent the engine from overrunning.

Also in this case, as in the case of the fourth embodiment, the automobile can be driven only at low speed by setting the stroke of the push rod 51 so that a small amount of fuel can be delivered from the fuel injection pump.

Moreover, the three-way solenoid valve 91 may be used as a simple backup governor to counter trouble by controlling the duty ratio of the operation of the three-way solenoid valve 91.

In the fifth embodiment shown in FIG. 9, furthermore, the allowable maximum fuel delivery can be adjusted with the rise of the supercharging pressure, as in the case of the second embodiment, by connecting an atmosphere port (not shown) of the three-way solenoid valve 91 to the air inlet passage of the engine.

Figure 10:
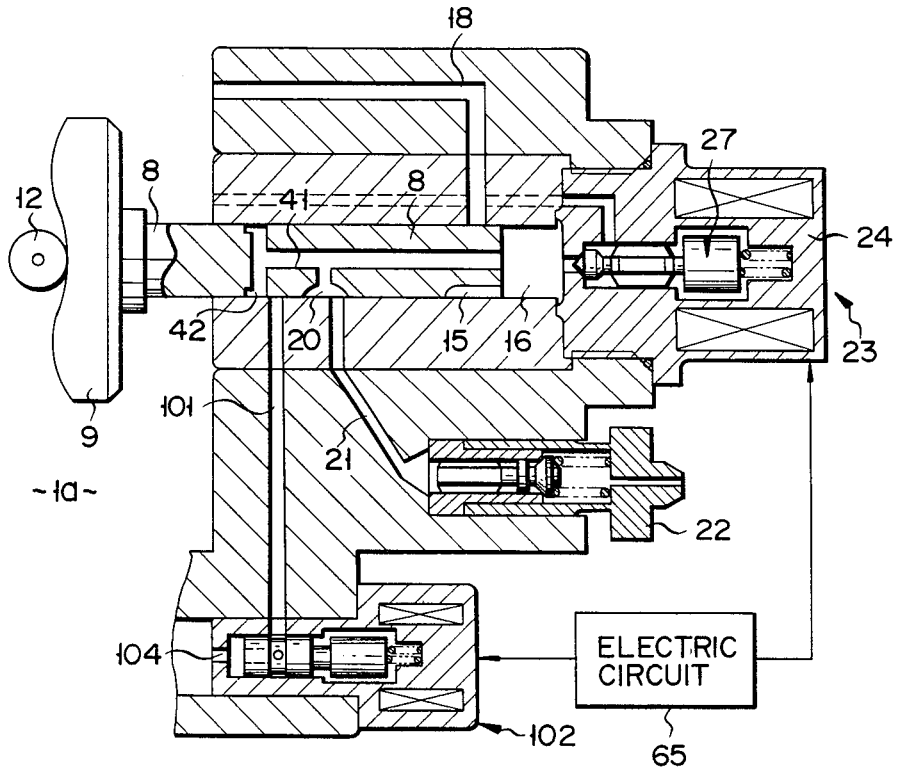
FIG. 10 is a partial sectional view of a distributor-type fuel injection pump according to a sixth embodiment of the invention.

Referring now to FIG. 10, there is shown the principal part of the fuel injection pump according to the sixth embodiment of the invention. In this sixth embodiment, a second escape passage 101 is formed in the distributing head 13 so that it communicates with the escape passage 41 whenever the pump plunger 8 is in its fuel compression stroke. The second escape passage 101 opens into the fuel supply chamber 1*a*. A spool-type solenoid valve 102 is disposed in the middle of the second escape passage 101. The solenoid valve 102 has its solenoid energized by the electric circuit 65 and its spool moved to the right of FIG. 10 when the solenoid valve 27 fails to be opened normally. Thus, the second escape passage 101 is opened to allow the compressed fuel in the pump chamber 16 to escape into the fuel supply chamber 1*a*.

The actuator mechanism is not limited to the solenoid or negative-pressure servomechanism described in connection with the above embodiments. For example, a DC motor, linear solenoid or any other suitable actuator may be used for the actuator mechanism.

Further, the present invention is not limited to the distributor-type fuel injection pump using the face cam system, and may also be applied to a fuel injection pump of a conventional inner cam type, which need only be provided with an escape port or escape lead so that the escape passage is opened to the low-pressure side with a rotation angle of the drive shaft which matches the predetermined fuel delivery.

What is claimed is:

1. A fuel injection pump for delivering fuel to a plurality of cylinders of an internal combustion engine, comprising:

a pump housing with a pump chamber defined therein to which fuel is supplied from a fuel tank;

fuel compression and delivery means for compressing fuel in said pump chamber and delivering said compressed fuel to said engine cylinders, said fuel compression and delivery means including a pump plunger adapted to be reciprocated so as to introduce fuel into said pump chamber and to pressurize said introduced fuel;

spill means for spilling to a low-pressure side on a fuel tank side said compressed fuel which was pressurized in said pump chamber to be delivered from said pump chamber toward said engine cylinders, said spill means including a spill passage communicating with said pump chamber of said pump housing and including a solenoid valve disposed in said spill passage for opening and closing said spill passage with a predetermined timing;

escape means for allowing said compressed fuel pressurized in said pump chamber to escape to said low-pressure side on said fuel tank side, said escape means including an escape passage formed in said pump plunger so as to be coaxial therewith and communicating with said pump chamber, one end of said escape passage opening to an outer peripheral surface of said pump plunger, a gate unit for opening and closing said escape passage, said gate unit having an escape ring fitted in a liquid-tight manner on said outer peripheral surface of said pump plunger so as to allow said pump plunger to reciprocate freely, said escape ring being adapted to open said escape passage when said pump plunger reaches a predetermined compression stroke, a rocking lever, one end of which is coupled to said escape ring and a central portion of which is rockably supported to define a pivot, actuator means for rocking said rocking lever, said actuator means having a pneumatic casing mounted on an outer wall of said pump housing, a diaphragm arranged in said pneumatic casing so as to define in the interior of said pneumatic casing an atmosphere chamber and an operating chamber, said diaphragm being movable from an initial position in response to the difference in pressure between said atmosphere and operating chambers, and an actuating rod, one end of which is coupled to another end of said rocking lever and another end of which penetrates outer walls of said pump housing and pneumatic casing so as to couple to said diaphragm;

a vacuum pump connected to said operating chamber of said pneumatic casing through an air pipe and driven by said engine; and a solenoid-operated cross valve located in said air pipe, said solenoid-operated cross valve having a first switching position for establishing a connection between said operating chamber and said vacuum pump, and a second switching position for breaking said connection and opening said operating chamber to the atmosphere;

wherein said actuating rod is moved together with said diaphragm in the axial direction of said rod in response to difference in pressure between said operating chamber and pneumatic chamber when said solenoid-operated cross valve is in said second switching position, thereby causing said rocking lever to rotate about said pivot on said pump plunger so as to adjust the position of said escape ring relative to said escape passage.

2. A fuel injection pump according to claim 1, wherein said actuator means includes spring means for maintaining said diaphragm in said initial position.

3. A fuel injection pump according to claim 2, wherein said spring means are separately provided in said atmosphere chamber and said operating chamber, and include a pair of coil springs for biasing said diaphragm in mutually opposing directions along the axial direction of said actuating rod.

4. A fuel injection pump according to claim 3, wherein said spring means further include adjusting means for adjusting a load setting of said coil springs.

5. A fuel injection pump according to claim 4, wherein said adjusting means include a screw screwed into said pneumatic casing, having one end protruding into said operating chamber and supporting therein one end of said coil spring.

6. A fuel injection pump according to claim 1, wherein said vacuum pump is adapted to draw power from a vacuum brake booster of a brake system for a vehicle.

7. A fuel injection pump according to claim 1, wherein said solenoid-operated cross valve is normally in said second switching position, and is switched to said first switching position whenever said solenoid valve in said spill passage fails to function properly.

8. A fuel injection pump for delivering fuel to a plurality of cylinders of an internal combustion engine, comprising:

a pump housing with a pump chamber defined therein to which fuel is supplied from a fuel tank;

fuel compression and delivery means for compressing fuel in said pump chamber and delivering said compressed fuel to said engine cylinders, said fuel compression and delivery means including a pump plunger adapted to be reciprocated so as to introduce said fuel into said pump chamber and to pressurize said introduced fuel;

spill means for spilling to a low-pressure side on a fuel tank side said compressed fuel which was pressurized in said pump chamber to be delivered from said pump chamber toward said engine cylinders, said spill means including a spill passage communicating with said pump chamber of said pump housing and including a solenoid valve disposed in said spill passage for opening and closing said spill passage with a predetermined timing; and escape means for allowing said compressed fuel pressurized in said pump chamber to escape to said low-pressure side on said fuel tank side, said escape means including an escape passage formed in said pump plunger so as to be coaxial therewith and communicating with said pump chamber, one end of said escape passage opening to an outer peripheral surface of said pump plunger, a gate unit for opening and closing said escape passage, said gate unit having an escape ring fitted in a liquid-tight manner on said outer peripheral surface of said pump plunger so as to allow said pump plunger to reciprocate freely, said escape ring being adapted to open said escape passage when said pump plunger reaches a predetermined compression stroke, a rocking lever, one end of which is coupled to said escape ring and a central portion of which is rockably supported to define a pivot, actuator means for rocking said rocking lever, said actuator means having a pneumatic casing mounted on an outer wall of said pump housing;

a diaphragm arranged in said pneumatic casing so as to define in the interior of said pneumatic casing an atmosphere chamber and an operating chamber, said diaphragm being movable from an initial position in response to the difference in pressure between said atmosphere and operating chambess, and an actuating rod, one end of which is coupled to another end of said rocking lever and another end of which penetrates outer walls of said pump housing and pneumatic casing so as to couple to said diaphragm;

a vacuum pump connected to said operating chamber of said pneumatic casing through a first air pipe and driven by said engine;

a second air pipe selectively associated with said first air pipe and connected to said intake passage of said engine; and a solenoid-operated cross valve located in a connection section between said first and second air pipes, said solenoid-operated cross valve having a first switching position for opening said first air pipe and closing said second air pipe, and a second switching position for opening said second air pipe and closing said first air pipe;

wherein said actuating rod is removed together with said diaphragm along an axial direction of said rod in response to the difference in pressure between said operating chamber and atmosphere chamber when said solenoid-operated cross valve is in said second switching position, thereby causing said rocking lever to rotate about said pivot on said pump plunger to adjust the position of said escape ring relative to said escape passage.

9. A fuel injection pump according to claim 8, wherein said actuator means includes spring means for maintaining said diaphragm in said initial position.

10. A fuel injection pump according to claim 9, wherein said spring means are separately provided in said atmosphere chamber and said operating chamber, and includes a pair of coil springs for biasing said diaphragm in mutually opposing directions along the axial direction of said actuating rod.

11. A fuel injection pump according to claim 10, wherein said spring means further include adjusting means for adjusting a load setting of said coil springs.

12. A fuel injection pump according to claim 11, wherein said adjusting means include a screw screwed into said pneumatic casing, having one end protruding into said operating chamber and supporting therein one end of said coil spring.

13. A fuel injection pump according to claim 8, wherein said vacuum pump is adapted to draw power from a vacuum brake booster of a brake system for a vehicle.

14. A fuel injection pump according to claim 8, wherein said solenoid-operated cross valve is normally in said second switching position, and is switched to said first switching position whenever said solenoid valve in said spill passage fails to function properly.

* * * * *